US009175919B2

(12) United States Patent
Russell et al.

(10) Patent No.: US 9,175,919 B2
(45) Date of Patent: Nov. 3, 2015

(54) SYSTEM AND METHOD FOR ATTACHING A SOUND SUPPRESSOR TO A FIREARM

(71) Applicants: Travis Russell, Springfield, OH (US); Logan Griggs, Springfield, OH (US)

(72) Inventors: Travis Russell, Springfield, OH (US); Logan Griggs, Springfield, OH (US)

( * ) Notice: Subject to any disclaimer, the term of this patent is extended or adjusted under 35 U.S.C. 154(b) by 0 days.

(21) Appl. No.: 14/461,375

(22) Filed: Aug. 16, 2014

(65) Prior Publication Data

US 2015/0253098 A1 Sep. 10, 2015

Related U.S. Application Data

(60) Provisional application No. 61/866,999, filed on Aug. 16, 2013.

(51) Int. Cl.
*F41A 21/00* (2006.01)
*F41A 21/30* (2006.01)
*F41A 21/32* (2006.01)

(52) U.S. Cl.
CPC ..... *F41A 21/30* (2013.01); *F41A 21/32* (2013.01)

(58) Field of Classification Search
USPC ..... 89/14.2, 14.4, 14.3
See application file for complete search history.

(56) References Cited

U.S. PATENT DOCUMENTS

| | | | | |
|---|---|---|---|---|
| 2003/0019351 | A1* | 1/2003 | Fluhr | 89/14.4 |
| 2005/0188829 | A1* | 9/2005 | Hanslick et al. | 89/14.3 |
| 2007/0095198 | A1* | 5/2007 | Dater et al. | 89/14.2 |
| 2012/0279381 | A1* | 11/2012 | Landolt | 89/14.4 |

* cited by examiner

*Primary Examiner* — J. Woodrow Eldred
(74) *Attorney, Agent, or Firm* — Miracle IP; Bryce D. Miracle

(57) ABSTRACT

The present invention provides for a system and method for easily, quickly and reliably attaching a sound suppressor or other auxiliary device to the muzzle end of a firearm barrel, and for easily and quickly removing such device therefrom. Moreover, the invention will allow any suppressor—threaded or unthreaded—to quickly, easily and reliably attach to a firearm utilizing a dual part system. The dual part system comprises a barrel adapter having the ability to attach directly to a non-threaded suppressor or a quick disconnect suppressor, or connect to a threaded suppressor utilizing a supplemental coupling adapter which connects to existing threaded suppressors.

6 Claims, 13 Drawing Sheets

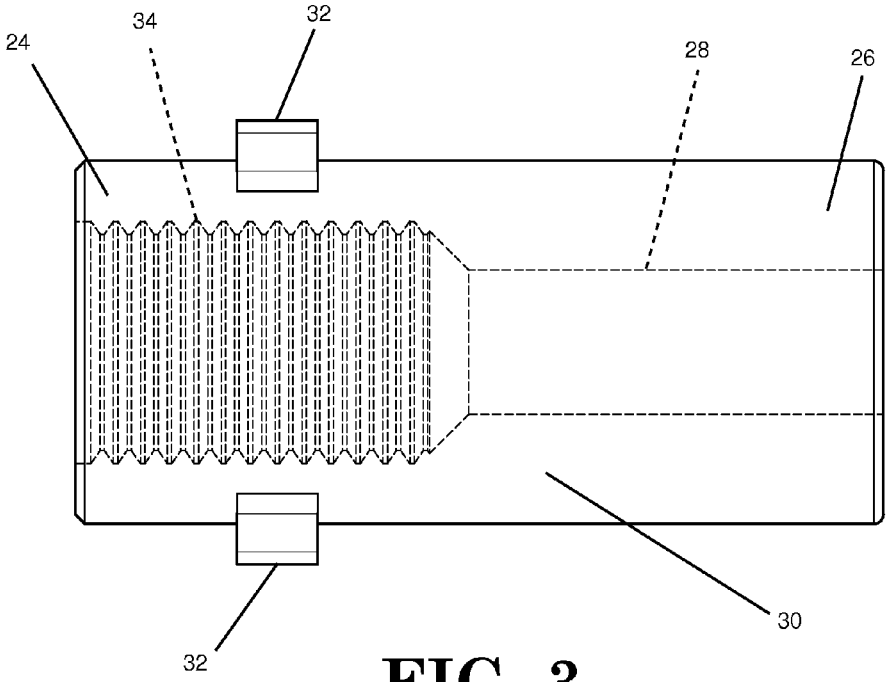
FIG. 3
FIG. 4
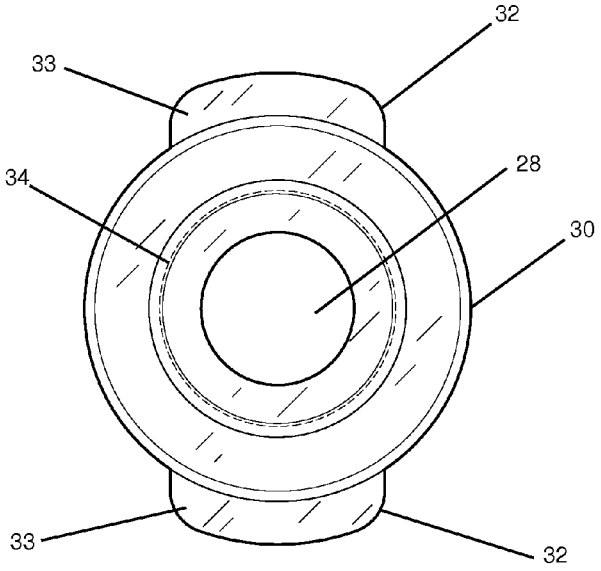

SYSTEM AND METHOD FOR ATTACHING A SOUND SUPPRESSOR TO A FIREARM

This application claims priority to U.S. Provisional Patent Application No. 61/866,999, filed Aug. 16, 2013, the contents of which are hereby incorporated by reference.

BACKGROUND

The present invention relates to firearms, and more particularly to a system and method for securing auxiliary attachments, such as a sound suppressor, to the muzzle of a firearm.

A sound suppressor is a device attached to or part of the barrel of a firearm which reduces the amount of noise and visible muzzle flash generated by firing. Suppressors are typically constructed of a metal cylinder with internal mechanisms to reduce the sound of firing by slowing the escaping propellant gas and sometimes by reducing the velocity of the bullet.

Apart from integral suppressors which are integrated as a part of the firearm's barrel, most suppressors have a "female" threaded end, which attaches to "male" threads cut into the exterior of the barrel.

Alternatively, firearms often utilize "quick-detach" suppressors which use coarser than normal threads and are installed over an existing muzzle device such as a flash suppressor and may include a secondary locking mechanism to allow the shooter to quickly and safely add or remove a sound suppressor based on individual needs.

Various systems are known in the firearms art for attaching a sound suppressor to a firearm. There nevertheless exists a need for improving such systems, particularly for increasing the ease by which a user may attach or detach a firearm with a sound suppressor, whether the sound suppressor is threaded or not threaded, while at the same time effecting a reliable securement there between capable of withstanding the vibrations incidental to the firing of such firearms as automatic rifles used by military personnel, and without adversely affecting accuracy or consistency of high precision firearms.

SUMMARY

The present invention provides for a system and method for easily, quickly and reliably attaching a sound suppressor or other auxiliary device to the muzzle end of a firearm barrel, and for easily and quickly removing such device therefrom. Moreover, the invention will allow any suppressor—threaded or unthreaded—to quickly, easily and reliably attach to a firearm utilizing a dual part system. The dual part system comprises a barrel adapter having the ability to attach directly to a non-threaded suppressor or a quick disconnect suppressor, or connect to a threaded suppressor utilizing a supplemental coupling adapter which connects to existing threaded suppressors.

Thus, providing a threaded sound suppressor connected to a coupling adapter and providing a non-threaded sound suppressor while in the field, a firearm that is outfitted with the barrel adapter can easily connect to—at the user's option—the non-threaded sound suppressor or the threaded suppressor in a seamless, timely manner.

In a version of the invention, the barrel adapter includes a bore, a proximal end, a distal end, and an outer surface. The proximal end of the barrel adapter is configured to couple to a firearm such that a projectile can pass through the body portion from the proximal end to the distal end through the bore. The outer surface of the barrel adapter has a plurality of stopping spokes utilized to secure the barrel adapter with either a non-threaded sound suppressor or connect to a threaded sound suppressor by interlocking with the coupling adapter that is attached to the threaded sound suppressor.

The coupling adapter is configured to attach to a silencer, typically by threading a threaded sound suppressor onto the coupling adapter. The coupling adapter includes an apparatus housing having a proximal end and a distal end, an external threaded connector for adapting to a threaded suppressor, and an internal bore for passing a projectile through from the proximal end to the distal end. Moreover, in a version, the coupling adapter comprises an internal spring loaded sleeve having a proximal end and a distal end configured to receive the body portion of the barrel adapter. The internal spring loaded sleeve is translatable within the apparatus housing along the at least one of the proximal and distal directions. An apparatus housing cap having a proximal end and a distal end is positioned at the proximal end of the apparatus housing and is configured to allow the barrel adapter to pass through the proximal end in order to engage the coupling adapter. The apparatus housing cap includes an internal shoulder with a plurality of notches for seating the plurality of stopping spokes of the barrel adapter while in the attached, locked position.

In a version of the invention, the plurality of stopping spokes are two outwardly projected geometric shapes positioned on opposing sides of the outer surface near the proximal end of the barrel adapter. The projected geometric shapes have opposing flat surfaces which are perpendicular to the outer surface of the body portion of the barrel adapter. Correspondingly, the plurality of internal shoulders are two notches configured to receive the opposing geometric shapes.

Other systems may comprise other variations and combinations. The aforementioned version should not be construed in the limiting sense. The invention can be tailored to fit any caliber and the threading can vary depending on what is needed.

BRIEF DESCRIPTION OF THE DRAWINGS

These and other features, aspects, and advantages of the present invention will become better understood with regard to the following description and accompanying figures where:

FIG. 3 is a side elevation view of the barrel adapter of the version shown in FIG. 1;

FIG. 4 is a front elevation view of the barrel adapter of the version shown in FIG. 1;

DETAILED DESCRIPTION

Referring now to the figures wherein the showings are for purposes of illustrating a preferred version of the invention only and not for purposes of limiting the same, the present invention is a system and method for providing dual part combination that can easily connect to a non-threaded suppressor or a threaded suppressor with a supplemental coupling adapter. The dual part system comprises a barrel adapter having the ability to attach directly to a non-threaded suppressor or a quick disconnect suppressor, or connect to a threaded suppressor utilizing a supplemental coupling adapter which connects to existing threaded suppressors.

The following detailed description is of the best currently contemplated modes of carrying out exemplary versions of the invention. The description is not to be taken in the limiting sense, but is made merely for the purpose illustrating the general principles of the invention, since the scope of the invention is best defined by the appended claims.

Various inventive features are described below that can each be used independently of one another or in combination with other features.

Figure 1:
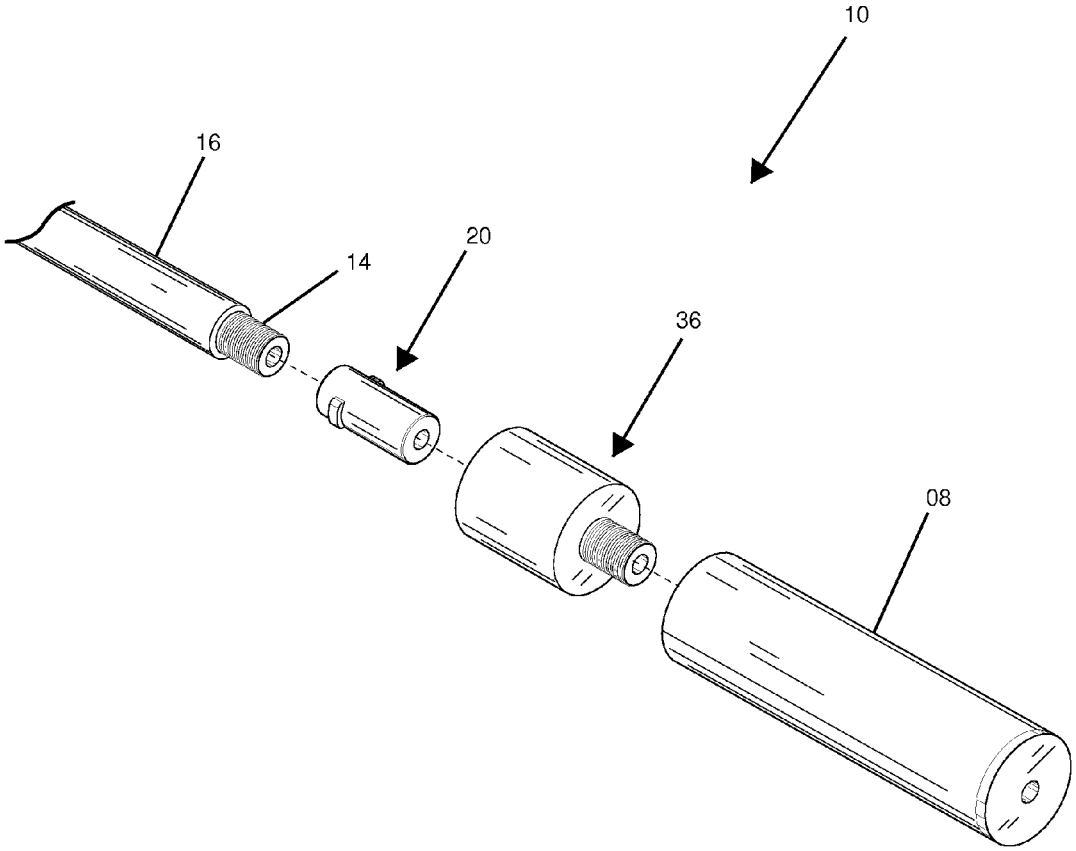
FIG. 1 is an exploded perspective view of the system embodying features of the present invention showing a firearm barrel, a barrel adapter, a coupling adapter, and a sound suppressor.

With reference now to the drawings, and in particular to FIG. 1 thereof, a new system and method embodying the principles and concepts of the present invention and generally designated by the reference numeral 10 will be disclosed.

In the version, the dual part system comprises a barrel adapter 20 having the ability to thread on to the muzzle of a firearm 16. The barrel adapter 20 is further configured to connect with a non-threaded suppressor or a quick disconnect suppressor, or connect to a threaded suppressor 08 utilizing the illustrated supplemental coupling adapter 36.

Providing a threaded sound suppressor 08 connected to a coupling adapter 36 and providing a non-threaded sound suppressor, a firearm that is outfitted with the barrel adapter 20 can easily connect to—at the user's option—the non-threaded sound suppressor or the threaded suppressor 08 in a seamless, timely manner.

Portions of the system 10, including barrel adapter 20 and coupling adapter 36 may be fabricated from any number of suitable materials, such as, without limitation, titanium, steel and aluminum. Likewise, the portions of the system 10 may be finished in any number of ways, including anodizing, painting, milling or left in their respective unfinished states. Due to the expected duty of the system 10, it is expected that the materials and finishing selected with provide for rough handling and unfavorable environmental conditions.

Figure 2:
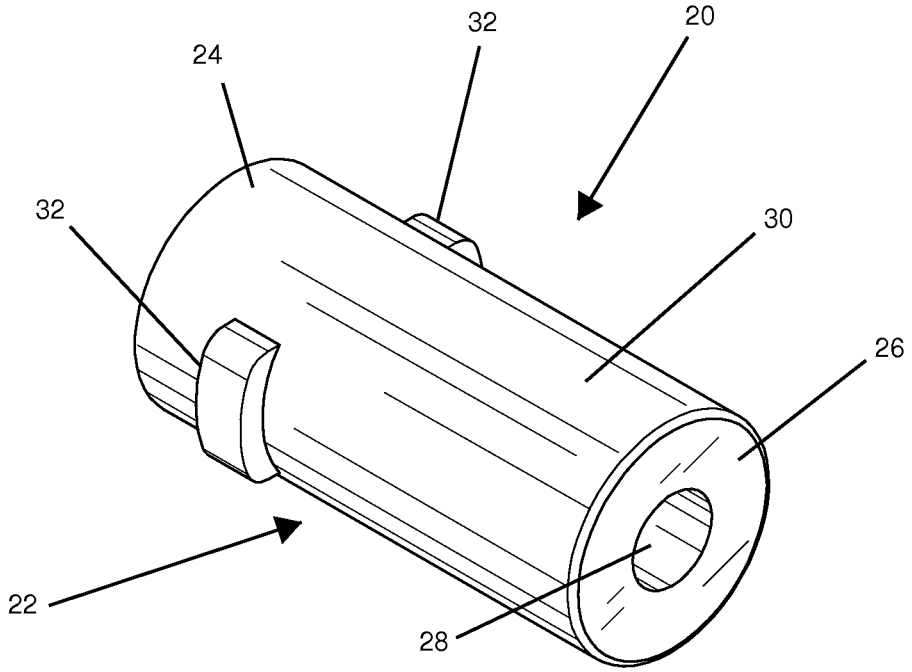
FIG. 2 is a side perspective view of the barrel adapter of the version shown in FIG. 1.
Figure 5:
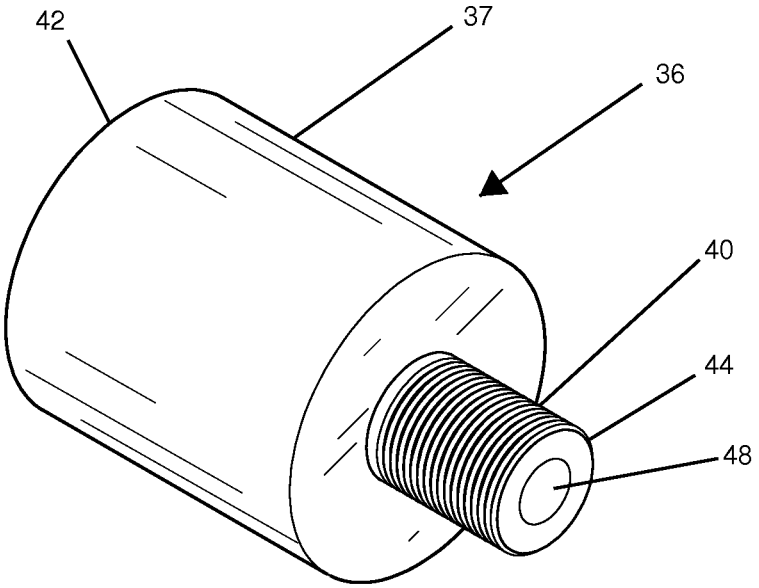
FIG. 5 is a side perspective view of the coupling adapter of the version shown in FIG. 1.
Figure 6:
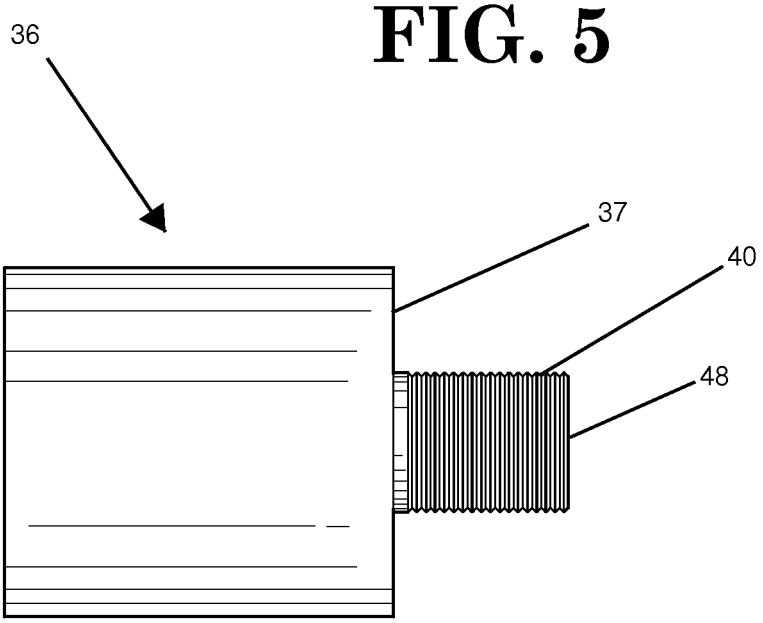
FIG. 6 is a side elevation view of the coupling adapter of the version shown in FIG. 1.
Figure 7:
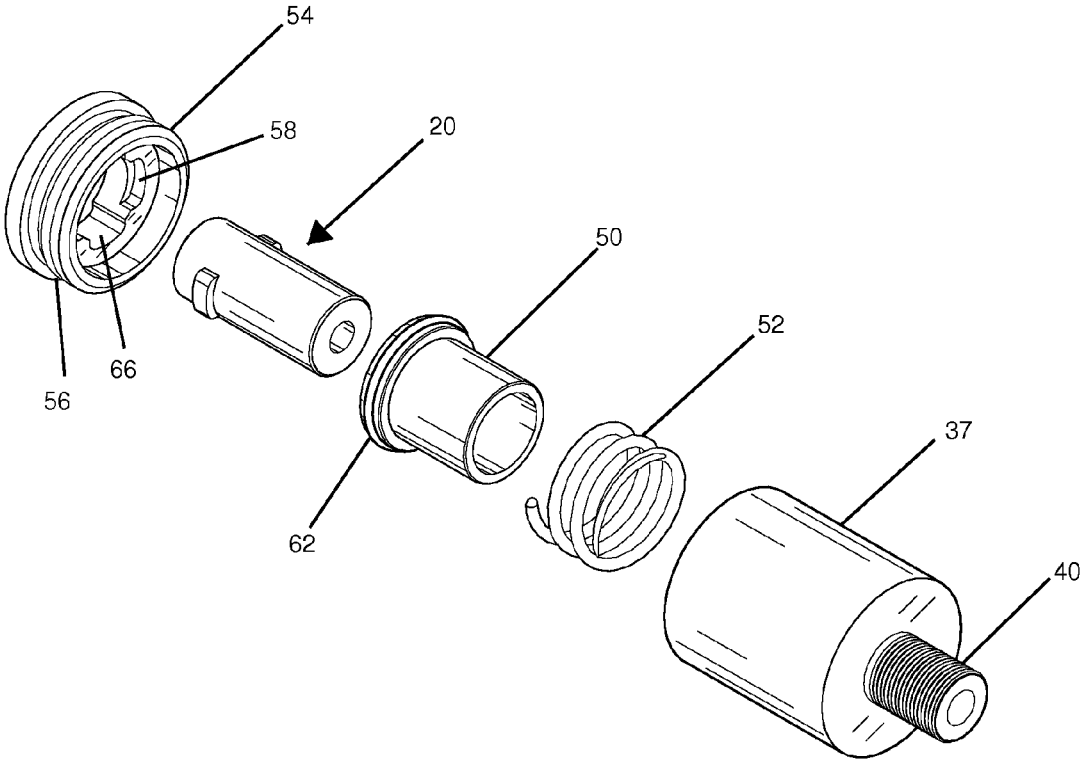
FIG. 7 is an exploded side perspective view of the coupling adapter of the version shown in FIG. 1.
Figure 8:
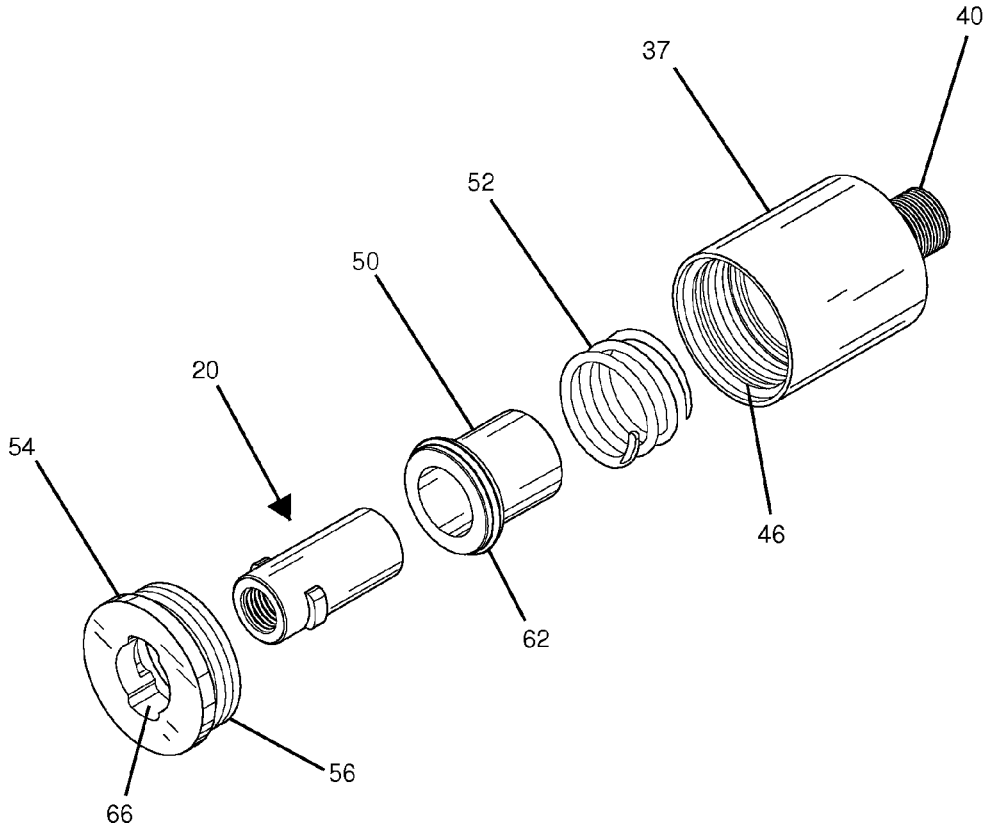
FIG. 8 is an exploded side perspective view of the coupling adapter of the version shown in FIG. 1.

As best illustrated by FIG. 2-FIG. 4, the barrel adapter 20 comprises a proximal end 24, a distal end 26, longitudinal bore 28 and an outer surface 30. The barrel adapter 20 is configured to couple to a firearm barrel 16 such that a projectile can pass through the longitudinal bore 28 from the proximal end 24 to a distal end 26.

The proximal end 24 of the barrel adapter 20 is configured to couple to an externally threaded 14 muzzle of a firearm 16. The proximal end 24 of the barrel adapter 20 comprises an internally threaded annular wall 34 which threads on to the threaded muzzle 16 for a secure fit. The fit is configured so that a projectile can pass from the muzzle 16 through the longitudinal bore 28 from the proximal end 24 to the distal end 26 unhindered.

Moreover, the outer surface 30 comprises a plurality of stopping spokes 32. More particularly, the plurality of stopping spokes 32 are two outwardly projected geometric shapes 32 positioned on opposing sides of the outer surface 30 near the proximal end 24. The plurality of stopping spokes 32 are geometrically configured to connect to either a coupling adapter 36 described below or to an unthreaded sound suppressor 08. The stopping spokes 32 can be in any configuration that carries out the intended operation of connection.

With reference now to FIG. 5-FIG. 9, the supplemental coupling adapter 36 will be described in detail. The coupling adapter 36 is configured to receive, connect and lock to the barrel adapter 20 for connecting a firearm to a threaded suppressor 08. As best depicted by the exploded perspective view FIG. 7, the coupling adapter 36 comprises an apparatus housing 37, and internal spring loaded sleeve 50, a coil spring 52, and an apparatus housing cap 54.

The apparatus housing 37 has a proximal end 42, a distal end 44, and external suppressor connector 40 for connecting to a sound suppressor, and an internal bore 48 for passing a projectile through from the proximal end 42 to the distal end 44. In the version, the external suppressor connector 40 is externally threaded in order to thread into a threaded sound suppressor 08.

In the version 10 illustrated, the internal bore 48 of the coupling adapter 36 passes longitudinally through the distal end 44 and formed within the external suppressor connector 40, thereby configured to receive a projectile from the distal end 26 of the barrel adapter 20 and passing through to an externally connected threaded suppressor 08.

As best illustrated by FIG. 9-FIG. 12, the coupling adapter 36 includes an internal spring loaded sleeve 50 which has a proximal end 51 and a distal end 53 configured to receive the distal end 26 of the barrel adapter 20, the internal spring loaded sleeve 50 is translatable within the apparatus housing 37 along the at least one of the proximal and distal directions, wherein the proximal end 51 of the spring loaded sleeve 50 includes an outwardly positioned stopping rim 64, wherein the stopping rim 64 is configured to stop the relative translation between the barrel adapter 20 and the spring loaded sleeve 50 as the spring loaded sleeve receives the barrel adapter 20.

An O-ring seal 62 may be utilized in order to seal the space between the sleeve 50 and the apparatus housing cap 54. The o-ring 62 is located exterior to the stopping rim 64 and contacts the interior of the apparatus housing cap 54.

Figure 9:
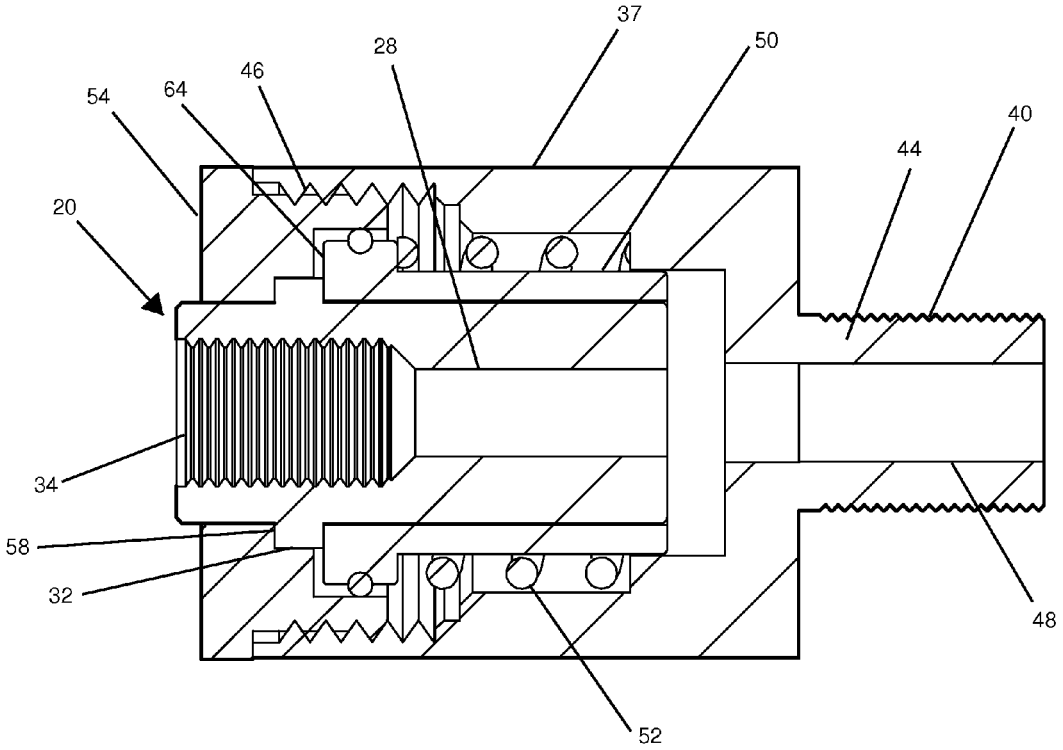
FIG. 9 is a sectional view of the coupling adapter of the version shown in FIG. 1.
Figure 10:
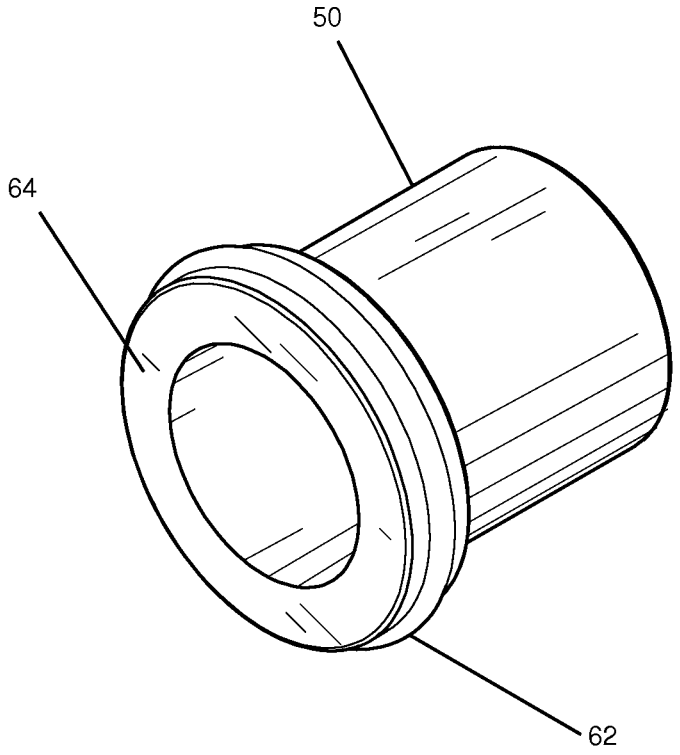
FIG. 10 is a side perspective view of the internal spring loaded sleeve of the coupling adapter of the version shown in FIG. 1.
Figure 11:
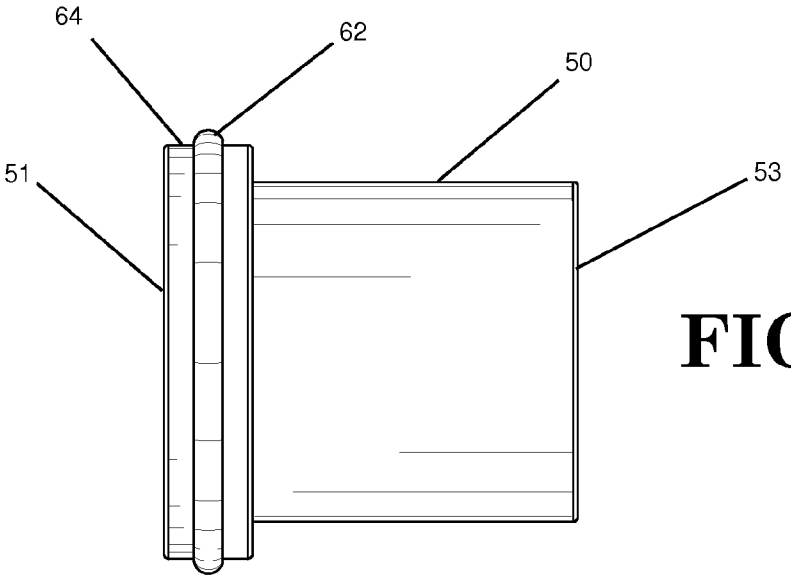
FIG. 11 is a side elevation view of the internal spring loaded sleeve of the coupling adapter of the version shown in FIG. 1.
Figure 12:
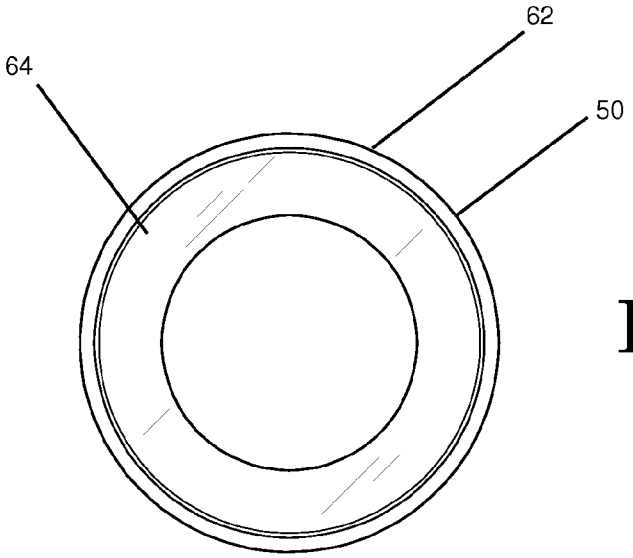
FIG. 12 is a front elevation view of the internal spring loaded sleeve of the coupling adapter of the version shown in FIG. 1.
Figure 13:
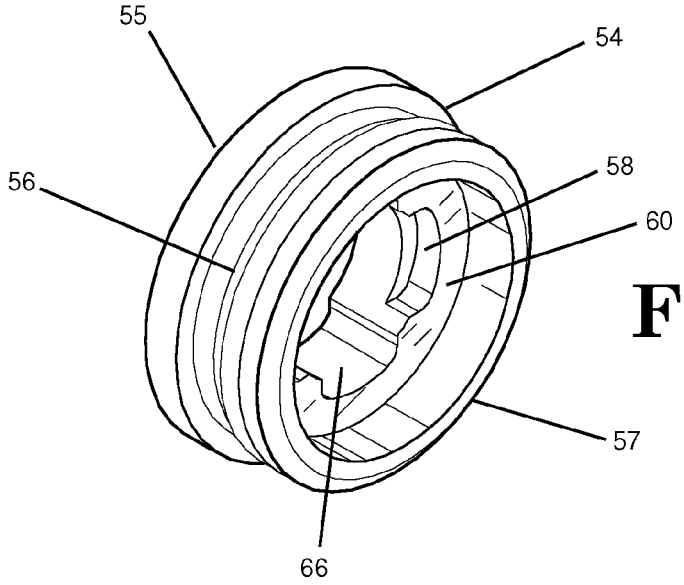
FIG. 13 is a side perspective view of the apparatus housing cap of the coupling adapter of the version shown in FIG. 1.
Figure 14:
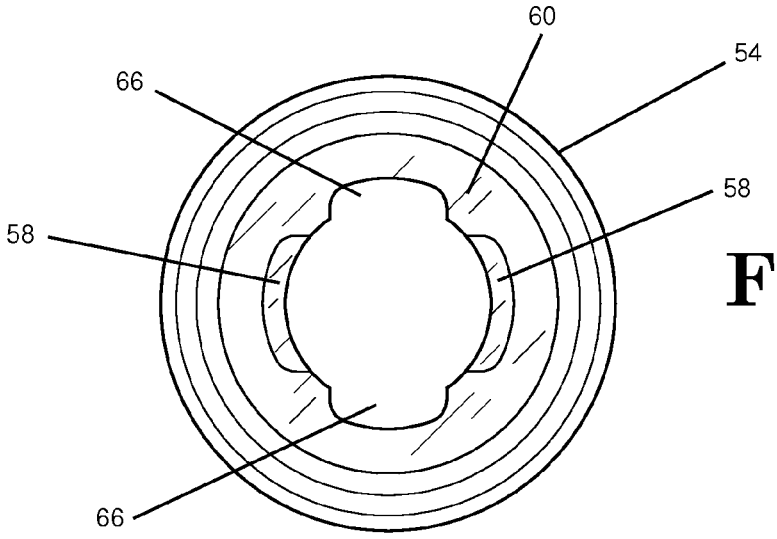
FIG. 14 is a rear elevation view of the apparatus housing cap of the coupling adapter of the version shown in FIG. 1.

With particular reference to FIG. 9, FIG. 13 and FIG. 14, the apparatus housing cap 54 has a proximal end 55 and a distal end 57, external threading 56 and an internal shoulder 60. The internal shoulder 60 includes two notches 58 which are configured to receive the two outwardly projected opposing geometric shapes 32 of the barrel adapter 20. Optionally, the internal shoulder may contain a plurality of notches. The apparatus housing cap 54 is positioned at the proximal end 42 of the apparatus housing 37. The apparatus housing 37 may be removable or may be fixed. In the version illustrated, apparatus housing cap 54 may connect to the apparatus housing 37 by threading external threads 56 with internal threading 46 of the apparatus housing 37.

The apparatus housing cap 54 is configured to allow the barrel adapter 20 to pass through the proximal end 55 in order to engage the coupling adapter 36. With that said, channels 66 provide ingress and egress of the barrel adapter 20—allowing passage of the two outwardly projected geometric shapes 32 when aligned with the channels 66.

Figure 15:
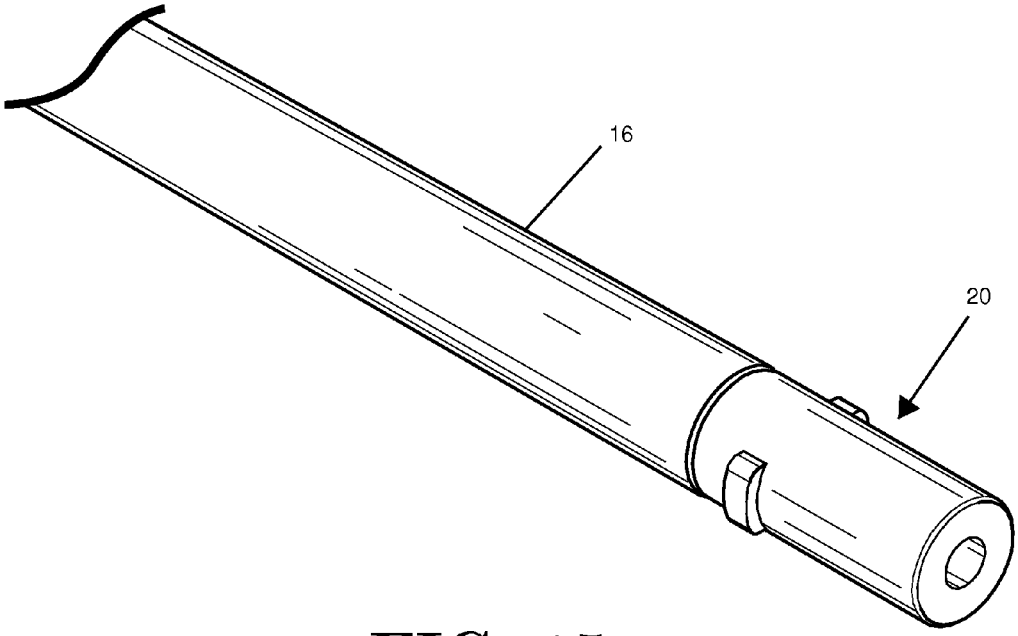
FIG. 15 is a perspective view of the barrel adapter attached to a firearm barrel of the version shown in FIG. 1.
Figure 16:
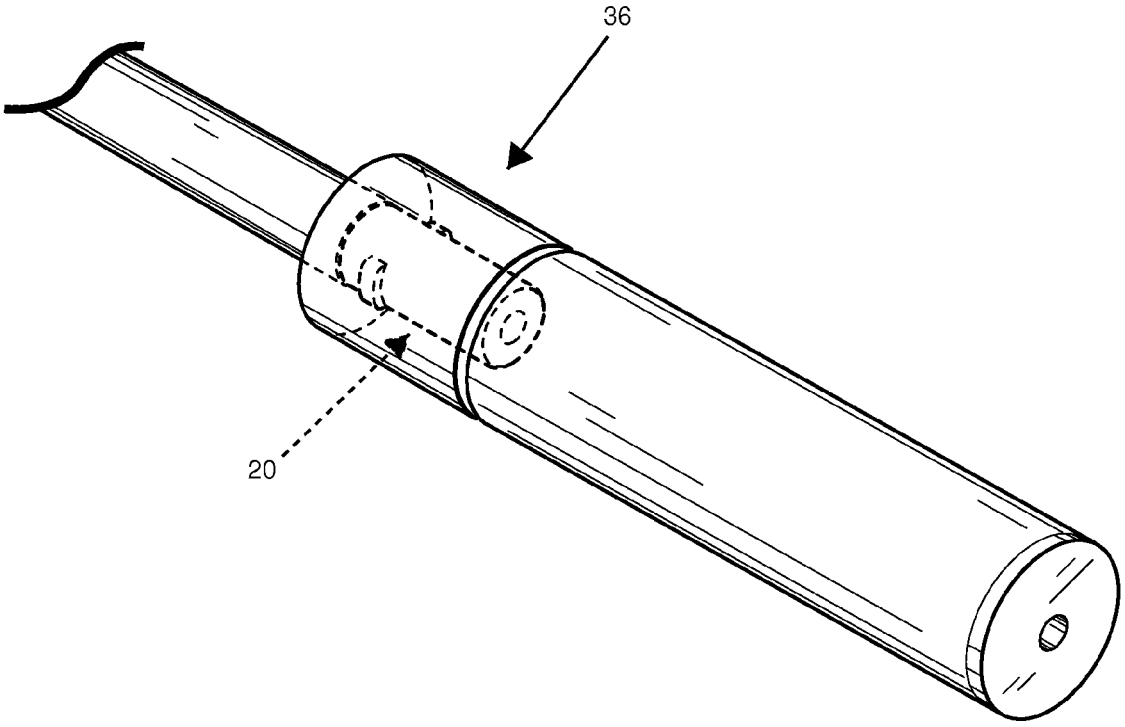
FIG. 16 is a perspective view of the system utilizing the barrel adapter and the coupling adapter to a threaded sound suppressor.
Figure 17:
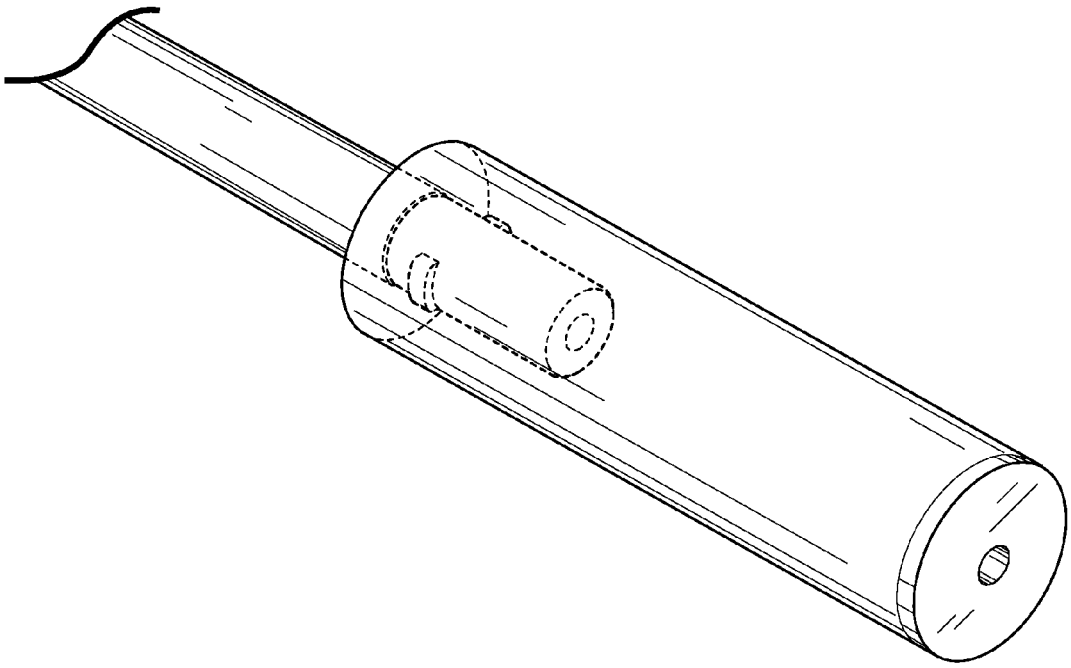
FIG. 17 is a perspective view of the system utilizing only the barrel adapter with a non-threaded sound suppressor.

Referring to all of the figures, particularly FIG. 15-FIG. 17. The following is the method of use of the above described system 10. First the barrel adapter 20 is connected to the externally threaded muzzle 16 of a firearm. The barrel adapter 20 is now ready to be connected to either a non-threaded suppressor (FIG. 17) or connected to the supplemental coupling adapter 36 for connection to a threaded suppressor (FIG. 18).

If the user desires to utilize a non-threaded suppressor or a quick detach suppressor, the non-threaded suppressor or quick detach is directly connected to the barrel adapter 20 by existing means (FIG. 17), thus the coupling adapter 36 is not needed. If the user desires to utilize a threaded suppressor, the coupling adapter 36 is utilized (FIG. 16). The coupling adapter 36 is first threaded onto the threaded suppressor by the external threaded connector 40. Next, the coupling adapter 36 is connected to the barrel adapter 20, distal end 26 through the apparatus housing cap 54 aligning the plurality of stopping spokes 32 with the channels 66. As the barrel adapter 20 moves into the coupling adapter 36, the barrel adapter 20 moves longitudinally into the internal spring loaded sleeve 50. The stopping spokes 32 make contact with the stopping rim 64 of the internal spring loaded sleeve 50. Consequently, the spring loaded sleeve 50 moves towards the distal end 44 of the apparatus housing 37 while the movement is resisted via the coil spring 52. Concurrently, the plurality of stopping spokes 32 move longitudinally past and through the channels 66. At this point, the user rotates the coupling adapter 36 in either direction which concurrently aligns the stopping spokes 32 with the plurality of notches 58 embedded within the shoulder 60 of the apparatus housing cap 54. At this point, the coupling adapter 36 is released and the plurality of stopping spokes 32 are seated with their correlated plurality of notches 58. Thus, locking the coupling adapter 36 onto the barrel adapter 20, secured by the internal spring loaded sleeve 50.

The invention can be made with variable thread configuration in order to carry out the desired connections. The invention can be made to fit any sized caliber of projectile.

The threading and the internal bore calibers of the coupling adapter 36 can be removable and interchangeable to allow one system to meet other parameters and requirements.

The invention may have the ability to apply grease or other lubricant within the coupling adapter 36 for a "wet can" application. The apparatus housing cap 54 allows the user to replace the internal spring loaded sleeve 50 and coil spring 52 thereof, while allowing the user to clean the internal functional parts. However, the apparatus housing cap 54 does not have to be made removable.

The present invention can be made in any manner and of any material chosen with sound engineering judgment. Preferably, materials will be strong, lightweight, long lasting, economic, and ergonomic.

Although preferred embodiments of the invention have been described in considerable detail, other versions and embodiments of the invention are certainly possible. Therefore, the present invention should not be limited to the described embodiments herein.

All features disclosed in this specification including any claims, abstract, and drawings may be replaced by alternative features serving the same, equivalent or similar purpose unless expressly stated otherwise.

What is claimed is:

1. A system for connecting a firearm to a suppressor, comprising:

(a) a barrel adapter comprising a bore, a proximal end, a distal end, and an outer surface, wherein the proximal is configured to couple to a firearm such that a projectile can pass through from the proximal end to the distal end through the bore, and wherein the outer surface has a plurality of stopping spokes; and (b) a coupling adapter configured to couple to a silencer comprising:

(i) an apparatus housing having a proximal end and a distal end, an external threaded connector for adapting to a threaded suppressor, and an internal bore for passing a projectile through from the proximal end to the distal end;

(ii) an internal spring loaded sleeve having a proximal end and a distal end configured to receive the barrel adapter, the internal spring loaded sleeve translatable within the apparatus housing along the at least one of the proximal and distal directions; and, (iii) an apparatus housing cap having a proximal end and a distal end and an internal shoulder with a plurality of notches for seating the plurality of stopping spokes of the barrel adapter, the apparatus housing cap is positioned at the proximal end of the apparatus housing and is configured to allow the barrel adapter to pass through the proximal end in order to engage the coupling adapter.

2. The system for connecting a firearm to a suppressor of claim 1, further comprising a coil spring coupled to the apparatus housing and to the internal spring loaded sleeve to allow translation of the spring loaded sleeve relative to the housing.

3. The system for connecting a firearm to a suppressor of claim 1, wherein the proximal end of the spring loaded sleeve comprises an outwardly positioned stopping rim, wherein the stopping rim is configured to stop the relative translation between the barrel adapter and the spring loaded sleeve as the spring loaded sleeve receives the distal end of the barrel adapter.

4. The system for connecting a firearm to a suppressor of claim 3, wherein the stopping rim further comprises an o-ring located exterior the stopping rim, the o-ring positioned to contact the interior of the distal end of the apparatus housing cap.

5. The system for connecting a firearm to a suppressor of claim 1, wherein the plurality of stopping spokes are two outwardly projected geometric shapes positioned on opposing sides of the outer surface near the proximal end of the barrel adapter, the projected geometric shapes having opposing flat surfaces which are perpendicular to the outer surface of the barrel adapter and wherein the internal shoulder having two notches configured to receive the opposing geometric shapes.

6. A system for connecting a firearm to a suppressor, comprising:

(a) a barrel adapter comprising:

i) a bore, a proximal end, a distal end, and an outer surface, wherein the proximal end is configured to couple to a firearm such that a projectile can pass through from the proximal end to the distal end through the bore, and wherein the outer surface has two outwardly projected geometric shapes positioned on opposing sides of the outer surface near the proximal end of the barrel adapter; and (b) a coupling adapter configured to couple to a silencer comprising:

(i) an apparatus housing having a proximal end and a distal end, an external threaded connector for adapting to a threaded suppressor, and an internal bore for passing a projectile through from the proximal end to the distal end;

(ii) an internal spring loaded sleeve having a proximal end and a distal end configured to receive the barrel adapter, the internal spring loaded sleeve translatable within the apparatus housing along the at least one of the proximal and distal directions, wherein the proximal end of the internal spring loaded sleeve comprises an outwardly positioned stopping rim, wherein the stopping rim is configured to stop the relative translation between the barrel adapter and the spring loaded sleeve as the spring loaded sleeve receives the barrel adapter, and wherein the stopping rim further comprises an o-ring located exterior the stopping rim; and (iii) an apparatus housing cap having a proximal end and a distal end and an internal shoulder with two notches configured to receive the geometric shapes of the barrel adapter, the apparatus housing cap is positioned at the proximal end of the apparatus housing and is configured to allow the barrel adapter to pass through the proximal end in order to engage the coupling adapter.

* * * * *